United States Patent [19]

Huie

[11] 3,944,136

[45] Mar. 16, 1976

[54] SMALL BUILDING HEATING SYSTEM

[76] Inventor: Edwin C. Huie, 6343 SE. Thorburn Ave., Portland, Oreg. 97215

[22] Filed: Feb. 3, 1975

[21] Appl. No.: 546,340

[52] U.S. Cl. ..... 237/55; 98/48; 126/116 R; 165/DIG. 2

[51] Int. Cl.[2] ..... F24B 7/02

[58] Field of Search ..... 126/110 R, 110 B, 116 R, 126/117; 237/55, 54; 165/111; 98/46, 58, 48

[56] References Cited

UNITED STATES PATENTS

| | | | |
|---|---|---|---|
| 1,953,302 | 4/1934 | Johnston | 126/117 X |
| 2,252,784 | 8/1941 | Powers | 126/99 |
| 2,362,940 | 11/1944 | Skerr | 165/39 |
| 2,468,909 | 5/1949 | Yeager et al. | 126/110 R X |
| 2,711,683 | 6/1955 | Ryder | 237/55 X |
| 2,715,018 | 8/1955 | Lapple et al. | 165/111 X |
| 2,764,391 | 9/1956 | Pullen | 165/122 |
| 3,813,039 | 5/1974 | Wells | 126/110 R X |

*Primary Examiner*—William E. Wayner
*Assistant Examiner*—William E. Tapolcai, Jr.
*Attorney, Agent, or Firm*—Klarquist, Sparkman, Campbell, Leigh, Hall & Whinston

[57] ABSTRACT

A heater unit and draft control adapted to be connected to an existing solid, liquid or gas fueled heating furnace includes a heat exchanger having a stack gas passage connected in series to a stack from the furnace and a blower which forces air through the heat exchanger and into the plenum of the furnace. A stack cooler and/or draft control includes a pipe extending from outside of the house into the exit portion of the stack gas passage with an adjustable damper therein.

9 Claims, 5 Drawing Figures

SMALL BUILDING HEATING SYSTEM

This invention relates to an improved small building heating system and has for an object thereof the provision of an improved home heating system and draft control using the principle of air or gases following the line of least resistance.

Another object of the invention is to provide an auxiliary heater adapted to be mounted in a stack flue, be connected to a stack cooler pipe and/or draft control pipe from outside the building and be connected to the plenum to supply air heated thereby to the plenum, or can be used to supply heated air to the immediate area or ducted to other areas.

A further object of the invention is to provide an improved auxiliary heating system including a heat exchanger mounted in the stack flue and a stack gas cooler and/or draft control leading from outside the building to the exit portion of the heat exchanger and having an adjustable damper.

Figure 3:
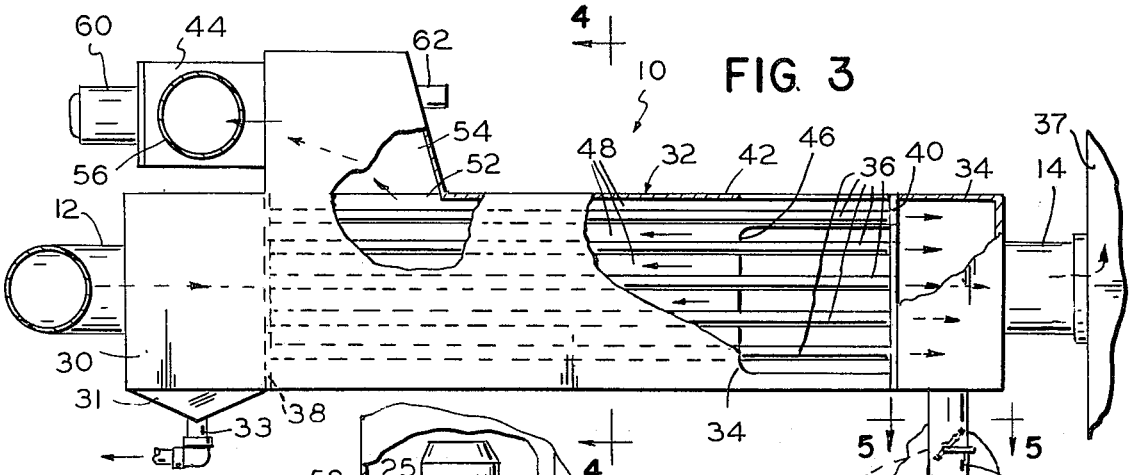
FIG. 3 is a horizontal sectional view taken along line 3—3 of FIG. 1.
Figure 2:
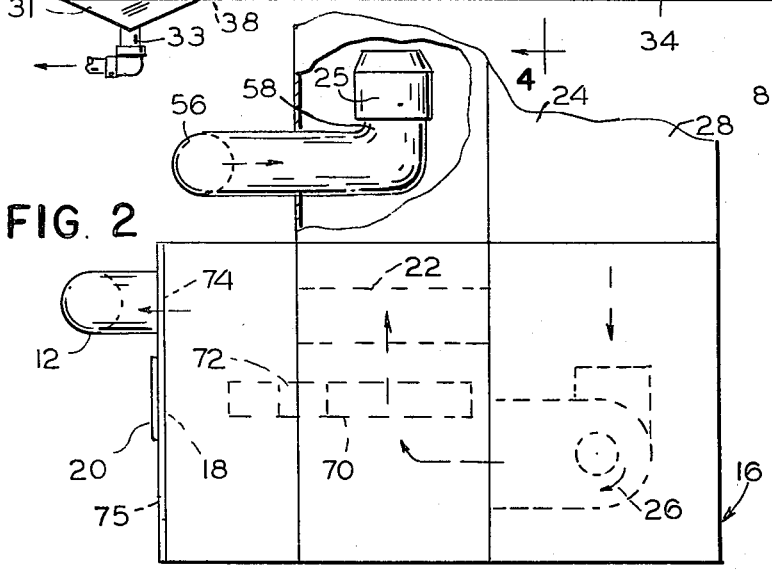
FIG. 2 is a vertical, sectional view taken along line 2—2 of FIG. 1.
Figure 5:
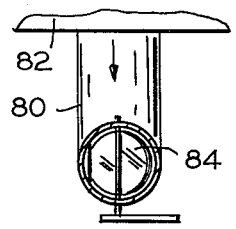
FIG. 5 is an enlarged, fragmentary, horizontal sectional view taken along line 5—5 of FIG. 3.
Figure 4:
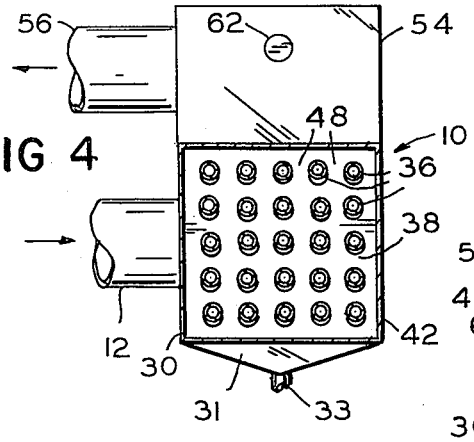
FIG. 4 is a vertical sectional view taken along line 4—4 of FIG. 3.
Figure 1:
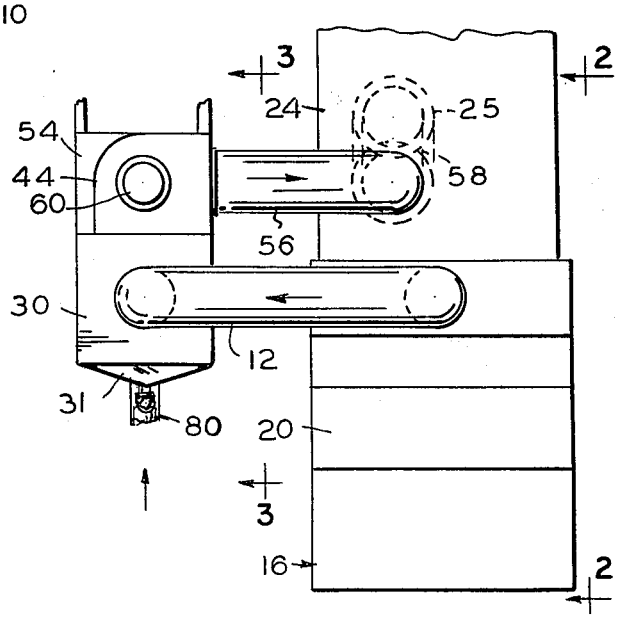
FIG. 1 is fragmentary, partially schematic, partially sectional front elevation view of an improved small building heating system forming one embodiment of the invention.

Referring now in detail to the drawings, there is shown therein an improved home or small building heating system forming one embodiment of the invention and including an auxiliary heating unit 10 mounted between stack flue sections 12 and 14 of a conventional furnace 16 having its stack cooling port 18 closed by a cover 20. The unit 10 picks up heat from a conventional furnace heat exchanger 22 and feeds heated air into a conventional plenum 24 of the furnace to mix with air heated in the plenum and forced to the rooms to be heated through the plenum 24 by a blower 26 of the furnace, cold air to the blower 26 being supplied by a cold air return duct 28 returning from the rooms to be heated.

The auxiliary heating unit 10 includes an entrance header 30, an elongated heat exchanger 32 and an outlet header 34. The smoke or flue gases from the furnace flow through the stack section 12 into the entrance header 30, through core pipes 36 of the heat exchanger, through outlet header 34 and stack section 14 to a chimney 37, and up the chimney to the outside. The pipes 36 are supported by and sealed in openings in header plates 38 and 40 sealed to inlet and outlet headers 30 and 34 by a sealing compound, such as an engine gasket cement. The heat exchanger 32 has an outer casing 42. Ambient air rom the furnace room is drawn by a fan 44 through inlet openings 46, through passages 48 surrounding the pipes 36 and through outlet opening 52 and outlet chamber 54. The fan blows the heated air through pipe 56 and an outlet 58 into the plenum, the outlet being directed longitudinally of the plenum and along the air duct 24. The outlet 58 has a large concentric sleeve 25 thereover which is slightly tapered to give a venturi effect to tend to draw air from the heat exchanger. The fan 44 is driven by an electric motor 60 controlled by an adjustable thermostat 62 responsive to heat in the outlet chamber 54, the thermostat actuating the motor 60 whenever the air in the chamber 54 is warm (not less than a predetermined temperature) the chamber 54 being above the heat exchanger portion. The furnace 16 is of conventional construction except for the closure of the opening 18 and includes a burner 70, a combustion chamber 72 under the plenum and an exhaust opening 74. An air inlet 75 to the burner 70 is provided at the front of the furnace. If desired, the auxiliary heating unit can omit the fan 44 and use only the venturi effect. Also, instead of supplying heated air to the plenum, the heat exchanger 32 can be connected in the cold air return and deliver heated air to the cold air inlet of the furnace. In the latter arrangement, the heat exchanger 32 can be connected in series with the cold air return to the duct 28 or can be in a branch conduit of the cold air return with the branch feeding into the duct 28.

To further cool the stack gases and optimize draft, a stack gas cooling pipe 80 leading from the outside of the building through wall 82 opens into the bottom of the outlet header 34. The pipe 80 has a damper 84 therein which is manually adjustable between a fully open position and a partially closed position, as shown. The air from the pipe 80 joins the flow of the stack gases to the chimmey and decreases draft through the burner and heat exchanger to increase the extraction of heat from the flue gases by the heat exchangers.

In an alternate construction, a solenoid (not shown) is utilized to partially close the damper 84 to a position creating optimum draft through the burner and stack. The solenoid is actuated by the burner control to partially close the damper when the control turns the burner on. When the control turns the burner off, it also de-energizes the solenoid, and a spring (not shown) moves the damper to its fully open position, in which the draft through the burner, the furnace heat exchanger and auxiliary heat exchanger is greatly reduced, thus leaving this residual heat in the building. In one constructed embodiment, the damper 84 was manually adjustable and was set to a position in which, when the burner was on and with the motor 60 operating, the temperature of the stack gases in the entrance header was between 325° F. and 400° F. and the temperature at the exit end of the heat exchanger 32 was not greater than about 125° F. That is, the heat exchanger 32 extracted a very large part of the heat from the flue gases.

Since the heat exchanger 32 cools the flue gases to such a great extent, in some installations, condensation of moisture occurs in the pipes 36, and, to drain this away, the heat exchanger 32 is sloped slightly downwardly toward the outlet header 34 to drain all condensate through a trap 85 at the bottom of the pipe 80 and leading to a drain. Also, a sump 31 with a pipe 33 to a trap (not shown) may be provided in the entrance header 30, but this is not really necessary when the heat exchanger is sloped as described above.

The main object of my invention is necessitated by the fact that all previous attempts at extracting heat from exhaust gases by utilizing an auxiliary heat exchanger have been using heated air from within the structure itself to supply the draft. My invention will utilize air taken from outside the building ducted to the outlet header on the auxiliary heat exchanger joining the cooled exhaust gases to create a draft. This principle also saves heated air within the building from being drafted to the outside. Another consideration is the fact that if heated inside air is drafted outside, the pressure differential will cause cold air from the outside to enter the building. The above conservation of heat, plus the heat extraction from the auxiliary heat exchanger, will result in considerable fuel economy.

When the furnace burner goes off, the solenoid controlled damper opens and air following the line of least resistance will be diverted from the burner and furnace and auxiliary heat exchanger to the stack gas cooler and/or draft control, thus conserving the heat in the furnace heat exchanger and the heat in the auxiliary heat exchanger. This also conserves the warm air in the building which without this invention would be by natural draft exhausted up the chimney. The manual damper 84 can be preset in the stack gas cooler and/or draft control for different draft conditions, thus eliminating possible mechanical failure of the solenoid. The thermostat 62 is of a well known construction and of a fairly small variable, and serves to turn the motor 60 on when its temperature is raised to about 100° F., for example, and turns off the motor 60 when the temperature of the thermostat is about 80° F., for example.

The stack cooler and/or draft control connected to outside air can be connected to a stack flue of a furnace without the auxiliary heat exchanger. This will not be as efficient as with an auxiliary heat exchanger unless the furnace is equipped with a heat exchanger of sufficient size to give proper transfer of heat. However, architects, designers and builders in their search to provide more space have reduced the size of heating units and the result is that a large portion of usable heat is lost by it being exhausted up the chimney.

If a furnace using my draft control must compete with a fireplace or exhaust fan for air, outside air must be provided for proper combustion. This can be done by opening a door or window or outside air can be ducted to the furnace burner.

What is claimed is:

1. In a heating system for
a small building,
a chimney,
furnace means in the building including a burner means, combustion air supply means and flue gas exit means, stack means connecting the flue gas exit means to the chimney,
conduit means completely separate from the combustion air supply means and having an inlet outside the building and an outlet connected to the stack means for supplying outside air to the stack means to cool the flue gas and to act as a damper to control the flow of the flue gas to the chimney, and an auxiliary heat exchange means in the stack means upstream from the outlet of the conduit means and receiving heat from the flue gas.

2. The heating system of claim 1 wherein the auxiliary heat exchange means has an air passage having an inlet for receiving cooler air from the building and an outlet for discharging warmed air into the building.

3. The heating system of claim 2 including blower means for flowing air through the heat exchange means.

4. The heating system of claim 3 wherein the furnace means includes primary heat exchange means and primary blower means for flowing air along a predetermined path including the primary heat exchange means, the first-mentioned blower means being connected to said path to discharge into said path.

5. The heating system of claim 4 wherein the first-mentioned blower means is connected to said path at a point downstream from the primary blower means.

6. The heating system of claim 2 wherein the furnace means includes primary heat exchange means and primary blower means for flowing air along a predetermined path including the primary heat exchange means, the outlet of the air passage being connected to said path.

7. The heating system of claim 1 wherein the conduit means includes adjustable damper means for controlling the flow of air therethrough.

8. The heating system of claim 1 wherein the heat exchange means includes pipe means for conveying flue gases, the pipe means being sloped downwardly toward the chimney, and means for receiving condensate from the pipe means.

9. The heating system of claim 1 wherein the auxiliary heat exchange means includes a heat exchange section, an inlet header at one end of the heat exchange section and an outlet header at the other end of the heat exchange section.

* * * * *